United States Patent [19]

Bouillez et al.

[11] Patent Number: 4,532,392

[45] Date of Patent: Jul. 30, 1985

[54] ROTATING ARC ELECTRIC CIRCUIT BREAKER

[75] Inventors: Olivier Bouillez, Seyssins; Michel Imbert, Crolles, both of France

[73] Assignee: Merlin Gerin, France

[21] Appl. No.: 517,261

[22] Filed: Jul. 26, 1983

[30] Foreign Application Priority Data

Aug. 10, 1982 [FR] France ..... 82 14032

[51] Int. Cl.[3] ..... H01H 33/18; H01H 33/60; H01H 33/12; H01H 33/98

[52] U.S. Cl. ..... 200/147 R; 200/146 R; 200/148 B

[58] Field of Search ..... 200/148 B, 146 R, 144 B, 200/147 R

[56] References Cited

U.S. PATENT DOCUMENTS 3,858,015 12/1974 Deno ..... 200/148 B

FOREIGN PATENT DOCUMENTS 0053524 6/1982 European Pat. Off. .
2511238 9/1975 Fed. Rep. of Germany .
2447091 1/1979 France .
375309 6/1932 United Kingdom .

*Primary Examiner*—Robert S. Macon
*Attorney, Agent, or Firm*—Parkhurst & Oliff

[57] ABSTRACT

A rotating arc circuit breaker comprises a blow-out coil fitted at the rear face of an annular electrode and containing a ferromagnetic core. A gas outlet channel is contrived inside coil in order to prevent any formation of an ionized gas lock in the zone defined by the rotating arc.

6 Claims, 3 Drawing Figures

ROTATING ARC ELECTRIC CIRCUIT BREAKER

BACKGROUND AND SUMMARY OF THE INVENTION

The invention relates to an electric circuit-breaker with self blow-out by rotation of the arc under the effect of a magnetic field generated by the current to be cut. The circuit breaker includes:

a sealed chamber filled with a gas of high dielectric strength, a stationary contact assembly, mounted freely inside the sealed chamber, an annular electrode pertaining to said stationary contact assembly and forming an annular track for the rotation of the arc under the effect of a magnetic field generated by a tubular coil fitted coaxially at the rear side of the annular electrode, a ferromagnetic core extending coaxially inside the tubular coil and presenting a terminal face adjacent to said annular electrode, and a channel contrived in said stationary contact assembly and passing through the tubular coil and the annular electrode.

Known circuit-breakers require only a very small amount of opening energy, due to the fact that the arc blow-out magnetic field is derivated from the current to be cut. The core is made up of a tubular metal element of ferromagnetic material which delimits the passage for the gas. This passage has a circular cross-section and contains a device which absorbs the decomposition residues of the blow-out gas. The device is fitted between two metal grids which cleanse and cool the blow-out gases. However, the presence of this device inside the channel holds up the normal flow of the outgoing gas and can lead to the formation of an ionized gas lock in the arc zone. The coil is surrounded coaxially by a ferromagnetic tubular yoke extending as a deflector contrived around the arc expansion zone. This deflector protects the chamber from the effects of the arc, but holds up the flow of gas around the stationary contact assembly. As a consequence, the cutting capacity of such a circuit breaker is limited.

The object of this invention is to overcome this difficulty and to make possible the manufacturing of an effective rotating arc circuit breaker.

According to the invention, the expansion zone of the arc at the front side of the stationary contact assembly communicates freely with the opposite rear zone, both through and around said assembly, the first inside trajectory of the gas passing through said channel, and the second trajectory passing outside between said stationary contact assembly and the inner wall of the chamber.

Tests have proved the efficiency of this device, which can be explained by an easier evacuation of the ionized gas out of the arc zone, namely out of the central zone defined by the rotating arc. It has already been proposed earlier to combine the magnetic blow-out and the pneumatic blow-out of the arc by generating in a rotating arc circuit breaker the blowing-out of the gases out of the arc zone either by a piston system, or by using self-expansion towards a separate expansion compartment. These systems are elaborate and require internal separations in the enclosure and/or of the volumes to be swabbed. Pneumatic blow-out participates to a considerable, sometimes predominant extent in the blowing-out of the arc. The present invention is based on a different conception, in so far that, on the one hand, it increases the magnetic blow-out, i.e. the rotation of the arc, by providing a ferromagnetic core inside the coil, and that, on the other hand, it prevents any formation of a stagnation zone of ionized gases in the central zone defined by the arc. The gases submitted to the effect of the arc can flow out freely on both sides of the arc towards cooler zones of the enclosure, whose total volume is thus used. This gas flow does not carry out any blowing-out of the arc. The core is preferably connected in series with respect to the blow-out coil, in order to maintain the magnetic blow-out in case of a switching of the arc onto the core. The outlet channel may be contrived inside the tubular core or between the internal face of the coil and the external face of a solid core of a smaller diameter, or may combine these two possibilities. The longitudinal profile of the outlet channel has preferably the shape of a jet pipe, with collars to which a contracting inlet is connected upstream, and an expanding outlet downstream, so as to facilitate the flowing out of the gas from the arc zone in the direction of the outlet.

According to a further development of the invention, the blow-out coil is surrounded externally by a yoke intended for strengthening the magnetic field, and the opposite electrode is provided with holes allowing the passage of the gas.

The invention will be described lower in detail as being applied to a circuit breaker with main contacts separated from the arc contacts, such as described in U.S. patent application Ser. No. 319,284, but it may of course be applied to any other type of rotating arc circuit breaker, for instance with main contacts coaxial to the arc contacts, or with separate contacts constituting the rotation tracks of the arc.

BRIEF DESCRIPTION OF THE DRAWINGS

Other advantages and features will appear more clearly from the following description of an application mode of the invention, given as a non limitative example and shown in the attached drawings, in which.

DETAILED DESCRIPTION OF A PREFERRED EMBODIMENT

Figure 1:
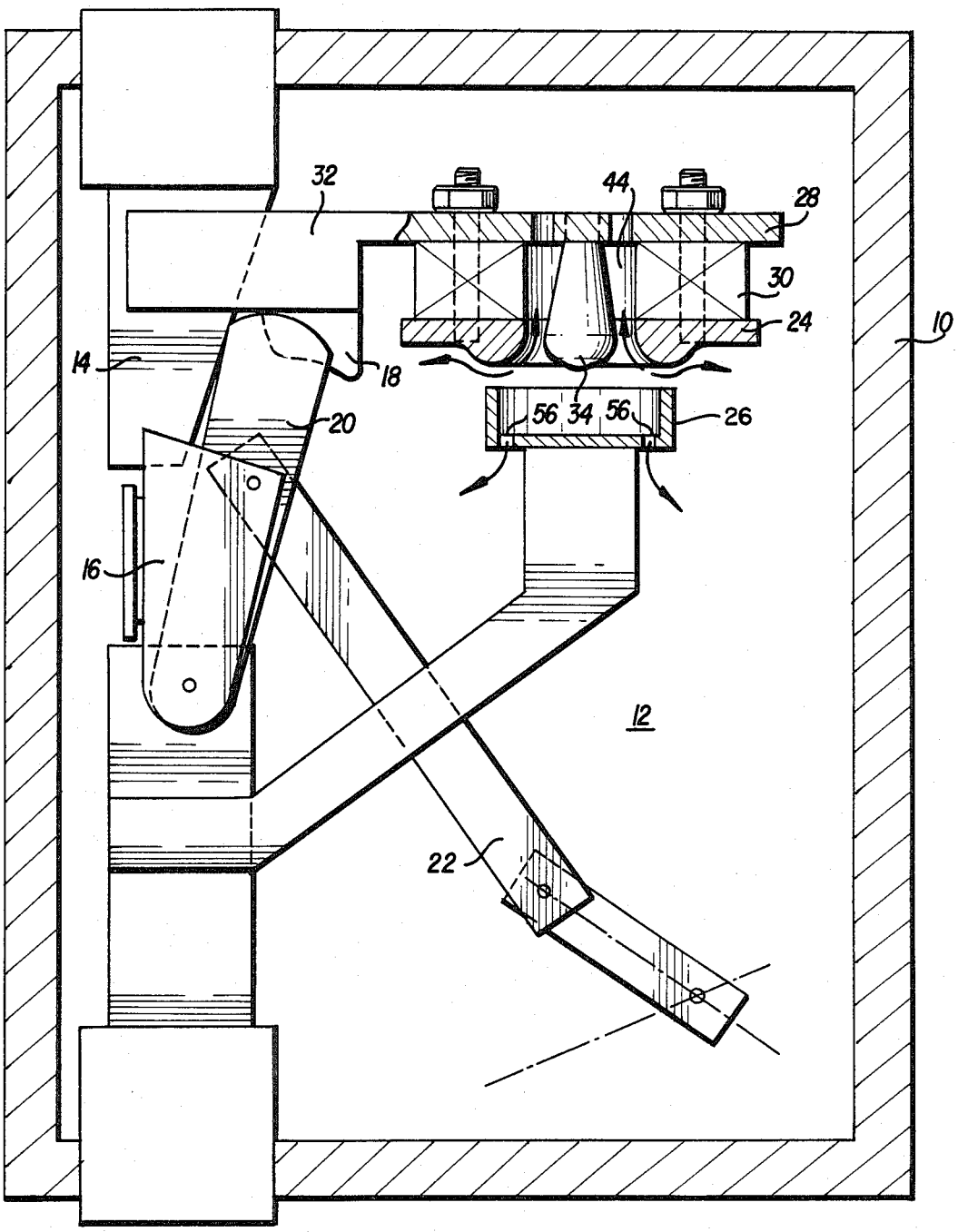
FIG. 1 is a schematic view of the axial cross-section of a circuit breaker according to the invention.

On FIG. 1, similar to that of U.S. patent application Ser. No. 319,284 filed Nov. 9, 1981, the disclosure of which is herein incorporated by reference, the sealed chamber 10 defines an enclosure 12 filled with a gas of high dielectric strength, such as sulphur hexafluoride. Enclosure 12 contains the main contacts 14, 16 and the by-pass contacts 18, 20, whose mobile contacts 16, 20 are actuated by mechanism 22. Chamber 10 also contains arc contacts made up of two annular electrodes 24, 26, fitted in front of each other and at a tangent to the displacement path of the end of the by-pass mobile contact 20. The annular electrode 24 is a part of a stationary assembly 28 comprising an annular coil 30 connected to the rear face of electrode 24 and fastened to support 32. Upon opening the circuit breaker the arc drawn between the bypass contacts 18, 20 switches onto the electrodes 24, 26, energizing blow-out coil 30 and entailing a rotation of the arc roots on the annular tracks formed by the electrodes 24, 26.

Figure 2:
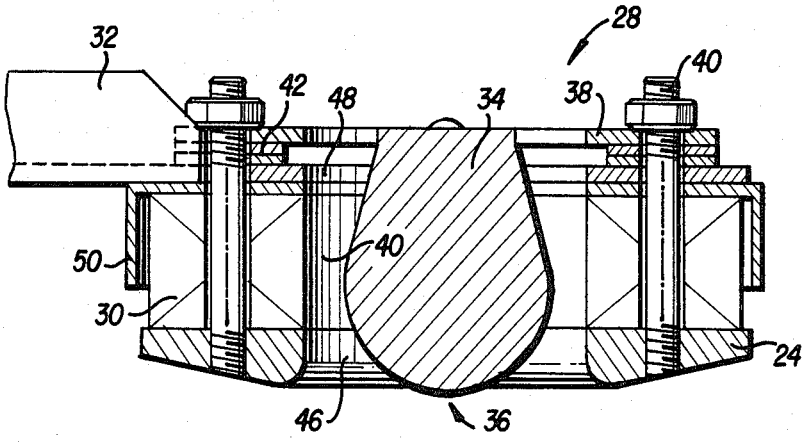
FIG. 2 is a magnified detail view of the fixed contact assembly as per FIG. 1.

Referring more particularly to FIG. 2, an olive-shaped ferromagnetic core 34 is placed inside coil 30, the front face or end 36 being in the vicinity of annular electrode 24. The rear part of core 34 fits on a fixing plate 38 fastened by studs 40 to support 32 over insulating washers 42. The studs 40 pass through coil 30 and are welded to the rear side of the annular coil 24. The ferromagnetic core 34 is electrically insulated from support 32, so as to maintain blow-out coil 30 energized in case of an arc striking core 34. Coil 30 is connected between support 32 and annular electrode 24. The diameter of core 34 is smaller than the internal diameter of coil 30 so as to provide an annular channel 44 (FIG. 1) allowing the gas to escape through stationary assembly 28. The olive shape of core 34 defines a jet pipe with a converging inlet 46 (FIG. 2) and an expanding outlet 48, which facilitates the evacuation of the ionized gas out of the arc zone adjacent to annular electrode 24. Inversely, any back flow towards annular electrode 24 is held up. A yoke 50 may be installed around coil 30.

The presence of core 34 and eventually of yoke 50 allows an increase the strength of the blow-out magnetic field of the arc anchored on annular electrode 24, and to blow it out. The warm gases ionized by the effect of the arc in the vicinity of annular electrode 24 can travel freely towards the outside and the inside, through channel 44. This prevents any stagnation of ionized gases in the central part of stationary contact assembly 28 that could hinder the blowing-out of the arc or cause re-arcing. This gas flow does not exert any direct blowing-out effect on the arc itself and participates only indirectly in the cutting of the current. The determination of the cross-section of the outlet channel 44 and of the core 34 results of a compromise between the need for an iron section sufficient to strengthen the magnetic field and the necessity of an outlet section sufficient not to hold up the gas flow.

Figure 3:
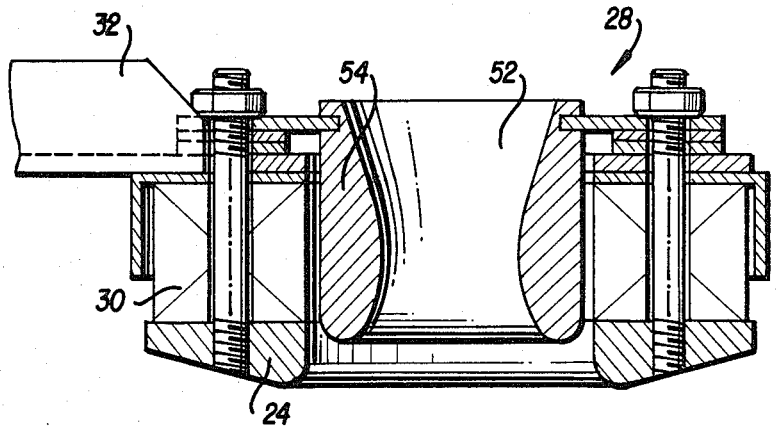
FIG. 3 is a view similar to FIG. 2, showing an alternative construction.

FIG. 3, similar to FIG. 2, shows a construction alternative for the stationary contact assembly 28, in which a gas outlet channel 52 is contrived inside a hollow core 54. Channel 52 is in the form of a jet pipe in order to facilitate the evacuation of the ionized gases out of the arc zone, and the working is obviously identical to that described above in relation to FIG. 2. Outlet through core 54 may be combined with an evacuation through the coil as represented by FIG. 2.

Referring to FIG. 1, it can be seen that annular electrode 26 opposite to electrode 24 is provided with holes 56 allowing the ionized gas to escape out of the central zone defined by the rotating arc. The gas evacuation system according to the invention may of course be applied to any other type of rotating arc circuit breaker, and the invention is not limited to the use more particularly described, and extends to a circuit breaker in which the core 34, 54 has not the same potential as the annular electrode 24, or to constructions in which the structure of the stationary contact assembly is different. It is to be observed that the first trajectory of the gas, inside, passes though channel 44, 52, while the second trajectory, outside, passes between the stationary contact assembly 28 and the inner side wall of chamber 10.

We claim:

1. An electric circuit breaker with self blow-out by rotation of an arc under the effect of a magnetic field generated by the current to be cut, said electric circuit breaker comprising:

a sealed chamber filled with an insulating gas of high dielectric strength;

a stationary contact assembly mounted inside said sealed chamber, said stationary contact assembly having a front zone and an opposite rear zone;

a first annular electrode associated with said stationary contact assembly, said first annular electrode having a front side and a rear side, said first annular electrode forming an annular track for the rotation of the arc under the effect of a magnetic field generated by a tubular coil fitted coaxially at the rear side of said annular electrode;

a ferromagnetic core extending coaxially inside said tubular coil and presenting a terminal face adjacent to said first annular electrode;

a channel extending axially through said tubular coil and first annular electrode of said stationary contact assembly, said channel extending between the front zone and the opposite rear zone of said stationary contact assembly; and an arc expansion zone arranged at said front zone of the stationary contact assembly and communicating freely with said opposite rear zone, said communication between the arc expansion zone and the opposite rear zone being both inside and outside said stationary contact assembly so as to define a first trajectory for ionized gas passing through said channel inside said stationary contact assembly, and a second trajectory passing outside said stationary contact assembly between said stationary contact assembly and an inner wall of said chamber.

2. The circuit breaker according to claim 1, wherein said channel is arranged coaxially in said ferromagnetic core and opens on both sides of said stationary contact assembly.

3. The circuit breaker according to claim 1, wherein said channel has an annular cross-section which is defined between an outer surface of said core and an inner surface of said tubular coil, the cross-section of the tubular coil being larger than the cross-section of the core.

4. The circuit breaker according to claim 2, wherein said channel includes a jet pipe having a contracting inlet directed towards the arc expansion zone and an opposite expanding outlet directed toward the opposite rear zone, so as to facilitate the flow of the ionized gas from said front zone towards said rear zone of the stationary contact assembly.

5. The circuit breaker according to claim 1, including main contacts placed laterally with respect to said coil and wherein:

said core is electrically connected to said annular electrode to maintain the coil energized in case of anchoring of the arc on the core;

a second annular electrode is spaced from said first electrode, said second annular electrode being arranged to face the front side of the first electrode; and said second electrode is provided with an auxiliary gas channel.

6. The circuit breaker according to claim 1, wherein the ferromagnetic core is hollow to permit the ionized gas to flow therethrough.

* * * * *